US008365970B2

(12) United States Patent
Matsui et al.

(10) Patent No.: US 8,365,970 B2
(45) Date of Patent: Feb. 5, 2013

(54) ELECTRIC STAPLER THAT DETECTS PAPER

(75) Inventors: Tomokazu Matsui, Chuo-ku (JP); Nobuaki Yagi, Chuo-ku (JP); Futoshi Kameda, Chuo-ku (JP); Yoshio Chigira, Chuo-ku (JP)

(73) Assignee: Max Co., Ltd., Tokyo (JP)

( * ) Notice: Subject to any disclaimer, the term of this patent is extended or adjusted under 35 U.S.C. 154(b) by 276 days.

(21) Appl. No.: 12/786,855

(22) Filed: May 25, 2010

(65) Prior Publication Data

US 2010/0301090 A1 Dec. 2, 2010

(30) Foreign Application Priority Data

May 28, 2009 (JP) ..... P.2009-128859
May 28, 2009 (JP) ..... P.2009-128860

(51) Int. Cl.

| | |
|---|---|
| ***B21J 15/28*** | (2006.01) |
| ***B27F 7/17*** | (2006.01) |
| ***B25C 5/02*** | (2006.01) |
| ***B25C 5/06*** | (2006.01) |
| ***B25C 7/00*** | (2006.01) |

(52) U.S. Cl. ..... 227/6; 227/155; 227/120

(58) Field of Classification Search ..... 227/107–139, 227/175.1–182.1; 73/159, 37.7, 862.381; *B27F 7/17; B25C 5/00, 5/02, 5/06, 7/00*
See application file for complete search history.

(56) References Cited

U.S. PATENT DOCUMENTS 4,444,491 A * 4/1984 Rinehart et al. ..... 355/50
4,623,082 A * 11/1986 Kurosawa ..... 227/7
5,269,451 A * 12/1993 Udagawa et al. ..... 227/120
5,346,114 A * 9/1994 Udagawa et al. ..... 227/120
5,595,336 A * 1/1997 Everdyke ..... 227/7
5,678,745 A * 10/1997 Yoshie ..... 227/4
5,791,543 A * 8/1998 Udagawa et al. ..... 227/4
6,039,230 A * 3/2000 Yagi et al. ..... 227/120
6,173,949 B1 * 1/2001 Visick et al. ..... 270/58.08
6,199,852 B1 * 3/2001 Visick et al. ..... 270/58.08
6,385,406 B1 * 5/2002 Funamizu et al. ..... 399/16
6,484,921 B2 * 11/2002 Hakozaki et al. ..... 227/2
6,698,640 B2 * 3/2004 Hakozaki et al. ..... 227/4
7,048,165 B2 * 5/2006 Haramiishi ..... 227/3

(Continued)

FOREIGN PATENT DOCUMENTS

EP 1 136 207 A1 9/2001
EP 2255935 A1 * 12/2010

(Continued)

*Primary Examiner* — Robert Long
(74) *Attorney, Agent, or Firm* — Drinker Biddle & Reath LLP

(57) ABSTRACT

An electric stapler includes: a driver for driving leg portions of a staple having a U-shaped section to penetrate the leg portions through a paper bundle; a table including a clincher for bending and forming the penetrated leg portions inwardly, the table for holding the paper bundle between the driver and the table; a motor for moving the table and the driver; a photo sensor for detecting an existence of the paper bundle inserted into a gap between the table and the driver; and a control portion for driving the motor. The photo sensor is disposed on the table in such a manner that a detection point of the photo sensor for detecting the paper bundle exists upwardly of a disposing position of the clincher by inclining an optical axis direction of a radiation light to be emitted from the photo sensor in a direction of the clincher.

4 Claims, 11 Drawing Sheets

U.S. PATENT DOCUMENTS

| | | | | |
|---|---|---|---|---|
| 7,090,110 | B2 * | 8/2006 | Adams et al. | 227/120 |
| 7,275,743 | B2 * | 10/2007 | Mui et al. | 271/207 |
| 7,306,131 | B2 * | 12/2007 | Bargo et al. | 227/119 |
| 7,311,236 | B2 * | 12/2007 | Smith et al. | 227/131 |
| 7,665,645 | B2 * | 2/2010 | Smith et al. | 227/155 |
| 7,938,306 | B2 * | 5/2011 | Sugihara et al. | 227/155 |
| 8,035,093 | B2 * | 10/2011 | Brumbaugh et al. | 250/559.4 |
| 8,146,908 | B2 * | 4/2012 | Terao | 270/58.09 |
| 2010/0171704 | A1 * | 7/2010 | Senft et al. | 345/168 |

FOREIGN PATENT DOCUMENTS

| | | |
|---|---|---|
| GB | 2 260 289 A | 4/1993 |
| JP | 2-219601 | 9/1990 |
| WO | WO 99/42253 | 8/1999 |

* cited by examiner

ELECTRIC STAPLER THAT DETECTS PAPER

This application claims priority from Japanese Patent Application No. 2009-128859, filed on May 28, 2009, and Japanese Patent Application No. 2009-128860, filed on May 28, 2009, the entire contents of which are hereby incorporated by reference.

FIELD OF THE INVENTION

The present disclosure relates to an electric stapler. More specifically, the present disclosure relates to an electric stapler which moves a table unit and a driver unit relative to each other to hold a bundle of sheets between the table unit and driver unit, drives the driver unit to penetrate leg portions of a staple so formed as to have a U-shaped section through a bundle of papers, and drives a clincher included in the table unit to inwardly bend and form the penetrated leg portions of the staple, thereby carrying out a series of binding processings.

DESCRIPTION OF RELATED ART

There is known a related-art electric stapler which is used bind a bundle of multiple papers (a paper bundle) using staples. The conventional electric stapler is incorporated in an ordinary copying machine, a Multiple-Function Printer (MFP) and the like, and has a function to automatically bind a bundle of papers (a paper bundle) such as copied papers or printed papers.

When the electric stapler is driven, a staple stored in a staple cartridge are guided to a forming position. The staple, which has been guided to the forming position, is formed into a U-like shape by a forming plate and is then struck out by a driver plate in a state where the leg portions of the staples are caused to face in a direction of the paper bundle. And, after the leg portions of the staple are penetrated through the paper bundle, the staple is guided by a clincher mechanism provided in a table or by a groove portion of a clincher formed in the table and the leg portions of the staples are thereby bent inwardly, which completes a paper bundle binding operation using the staple.

In order to positively carry out the paper bundle binding operation in the above-structured electric stapler, there is proposed an apparatus which includes a photo sensor for detecting a existence of the paper bundle and, when the paper bundle is detected by the photo sensor, starts the binding operation (see, for example, Japanese Patent Application Publication JP-A-H02-219601).

Here, in the case that a photo sensor for detecting the paper bundle is provided in the electric stapler, the photo sensor may preferably be disposed on a deep side (down-stream side) of the clincher position. Since, due to the disposition of the photo sensor on the deep side of the clincher position, the paper bundle can be detected by the photo sensor in a state where the paper bundle is surely inserted at the clincher position, a binding processing can be carried out at a proper binding position and also it is possible to prevent the binding processing from being started before the paper bundle is inserted to the clincher position.

However, to dispose the photo sensor on the deep side of the clincher position, actually, is not easy due to the structure of the electric stapler and, therefore, generally, the photo sensor has been often disposed on an upper-stream side of the clincher position. As a result of this, the paper bundle is detected by the photo sensor at a stage before the paper bundle is inserted completely, which the paper bundle binding operation by the stapler is carried out at a position existing on the upper-stream side of the proper binding position.

Also, in the case that the photo sensor is disposed on the upper-stream side of the clincher position, there can be also expected a method in which, the timing from the detection of the paper bundle by the photo sensor to the start of the binding operation is delayed slightly, whereby the binding operation is carried out at the timing when the paper bundle is surely inserted into the deep side. However, in this method, since the speed of the paper bundle insertion varies according to users. Accordingly, in the case that the timing to be delayed is too short, the binding processing is carried out before the paper bundle is inserted fully. On the other hand, in the case that the delaying time is too long, a user can, who judges that the binding processing will not be carried out, can draw out the paper bundle, and thus the binding processing is carried out in a state where no paper bundle exists, resulting in the idle striking of a staple.

Even in the case that the photo sensor is set at a position on the deep side of the clincher that is the ideal set position of the photo sensor, the paper bundle cannot be always inserted from the upper-stream side of the clincher position toward the deep side (down-stream side) thereof. Therefore, in the case that the paper bundle is inserted from other directions (for example, from a lateral direction) than the upper-stream side direction of a table, the paper bundle binding operation is carried out before the paper bundle is inserted fully and thus the paper bundle binding operation using the staple us carried out at a different position from the desired binding position.

Also, there is proposed a method in which a photo sensor including a light emitting portion and a light receiving portion formed integrally with each other is disposed on a lateral side of a clincher, and a disposed angle of the photo sensor is set so inclined that a optical axis of a radiating light emitted from the photo sensor can extend upwardly of the clincher, whereby the paper bundle inserted upwardly of the clincher can be detected quickly and positively. Further, there is also proposed a method in which there are employed two photo sensors respectively disposed on right and left lateral sides of the clincher in a state where the optical axes of the photo sensors are respectively inclined toward the clincher.

In the case that the two photo sensors are disposed respectively on the right and left sides of the clincher in this manner, the existence of the paper bundle can be detected at detection points of the respective photo sensors set upwardly of the clincher, which makes it possible to confirm the presence or absence of an insertion of the paper bundle quickly and positively.

However, in the case that a distance from positions of a table, on which the two photo sensors are respectively disposed, to a lower face of a magazine (or, a staple cartridge to be mounted onto the magazine) is short, it is hard to find a difference between the detection point in the photo sensor and the distance to the lower face of the magazine, thereby reducing the sensitivity (the S/N ratio) of the photo sensors for the presence or absence of the paper bundle. Therefore, the detection accuracy for the presence or absence of the paper bundle is reduced.

Also, in the case that two photo sensors are employed, in a state where no paper bundle exists, a radiation light emitted from the light emitting portion of one of the two photo sensors is reflected by the lower face of the magazine disposed opposed to the table and is received by the light receiving portion of the other photo sensor. And, similarly, a radiation light emitted from the light emitting portion of the other photo sensor is reflected by the lower face of the magazine and is received by the light receiving portion of one photo sensor.

In the case that the radiation light emitted by one photo sensor is received by the other photo sensor in this manner, the reflected light based on the radiation light output from the light emitting portion of one photo sensor and the reflected light based on the radiation light output from the light emitting portion of the other photo sensor are received at the same time in the respective light receiving portions of the two photo sensors. Thus, due to interference between the reflected lights (radiation lights) that have been received, it is difficult to detect the presence or absence of the insertion of the paper bundle with high accuracy.

SUMMARY OF INVENTION

Illustrative aspects of the present invention provide an electric stapler which can surely detect that a paper bundle is inserted fully into a clincher position before the electric stapler carries out a paper bundle binding operation.

Also, another illustrative aspects of the present invention provide an electric stapler in which two photo sensors are respectively disposed on right and left side portions of a clincher in such a manner that optical axes directions of radiation lights thereof are respectively inclined toward the clincher, and also in which, even in the case that the radiation light emitted from one photo sensor is received by the other photo sensor, the presence or absence of the paper bundle can be detected with high accuracy.

According to a first aspect of the invention, an electric stapler comprising:

a driver for driving leg portions of a bent-formed staple having a U-shaped section to penetrate the leg portions through a paper bundle;

a table including a clincher for bending and forming the penetrated leg portions inwardly, the table for holding the paper bundle between the driver and the table;

a motor for moving the table and the driver relative to each other;

a photo sensor for detecting an existence of the paper bundle inserted into a gap between the table and the driver; and a control portion for driving the motor when the paper bundle is detected by the photo sensor, wherein the photo sensor is disposed on the table in such a manner that a detection point of the photo sensor for detecting the paper bundle exists upwardly of a disposing position of the clincher by inclining an optical axis direction of a radiation light to be emitted from the photo sensor in a direction of the clincher.

Other aspects and advantages of the invention will be apparent from the following description, the drawings and the claims.

BRIEF DESCRIPTION OF THE DRAWINGS

FIG. 2A is a front view thereof, and FIG. 2B is a partial section view taken along the A-A line shown in FIG. 2A.

FIG. 3A is a front view thereof, and FIG. 3B is a partial section view taken along the B-B line shown in FIG. 3A.

FIG. 4A is a front view thereof, and FIG. 4B is a section view taken along the C-C line shown in FIG. 4A.

FIG. 5A is a front view thereof, and FIG. 5B is a section view taken along the D-D line shown in FIG. 5A.

FIG. 6A is a front view thereof, and FIG. 6B is a section view taken along the E-E line shown in FIG. 6A.

FIG. 7A is a front view thereof, and FIG. 4B is a partial section view taken along the E-E line shown in FIG. 7A.

DETAILED DESCRIPTION OF EXEMPLARY EMBODIMENTS

Now, description will be given below specifically of an electric stapler according to the exemplary embodiments with reference to the accompanying drawings.

First Exemplary Embodiment

Figure 1A:
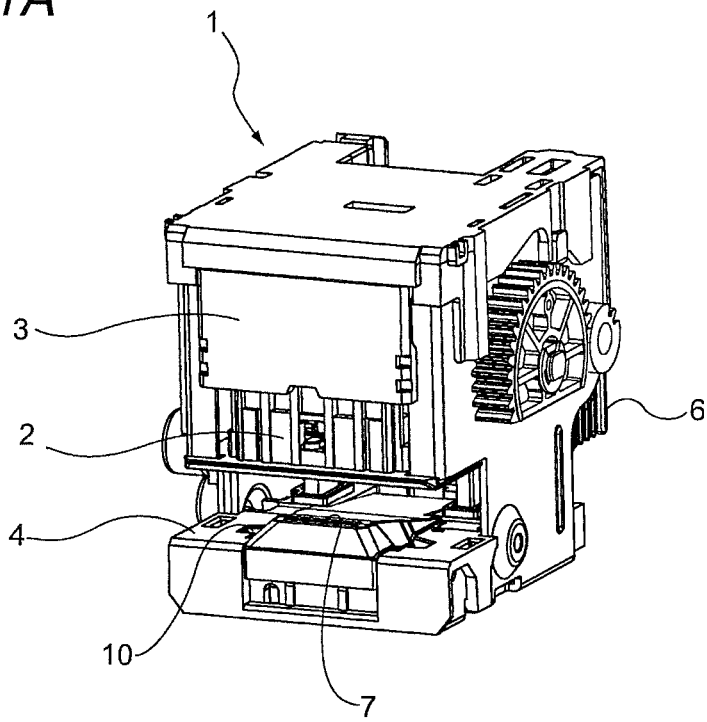
FIGS. 1A and 1B are perspective views of an electric stapler according to a first exemplary embodiment of the invention.
Figure 1B:
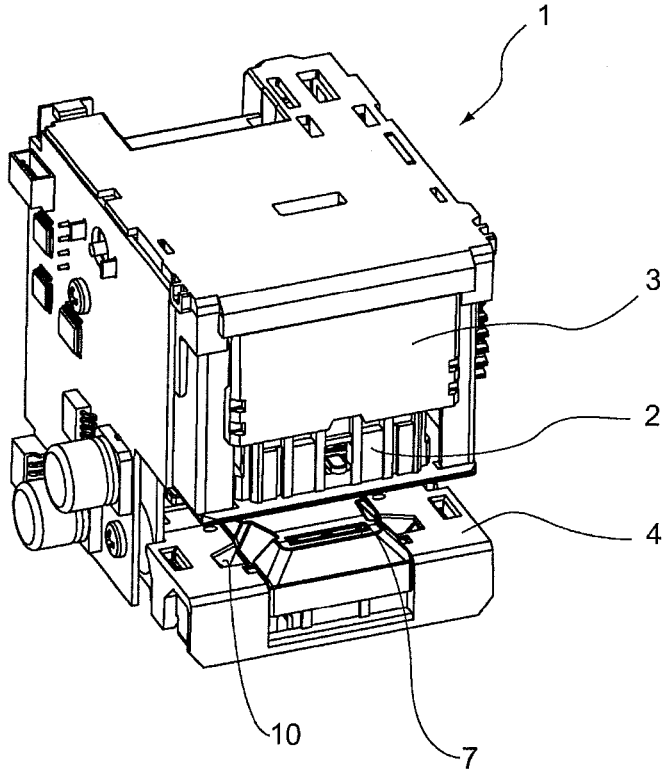

FIGS. 1A and 1B are respectively perspective views showing an electric stapler according to a first exemplary embodiment.

The electric stapler 1 includes a magazine 2, a driver unit (driver means) 3, a table (table means) 4, and a motor (not shown).

The magazine 3 is disposed in a central portion of the electric stapler 1 and has a function to hold a staple cartridge 6. When the staple cartridge 6 is inserted from a back face side of the electric stapler 1 into the magazine 2, the staple cartridge 6 can be mounted into the magazine 2.

The driver unit 3 is disposed upwardly of the magazine 2 and is held through a gear (not shown) in such a manner that it is spaced by a given distance from the magazine 2. The driver unit 3 includes a forming plate (not shown) for bending and forming a staple in such a manner that the staple has a U-shaped section, and a driver (not shown) for driving out the staple, which has been bent and formed by the forming plate, in a direction of the table 4.

The table 4 is disposed in a front side lower portion of the electric stapler 1 and includes, at a position which exists on an upper face of the table 4 and is opposed to the driver, a clincher 7 for inwardly bending and forming the leg portions of the staple driven out in the direction of the table 4. In the clincher 7, there is formed a groove portion which, in the case that the staple is pushed out by the driver, deforms the leg portions of the staple inwardly using a push-out force of the driver applied in a direction right under the driver.

Figure 2A:
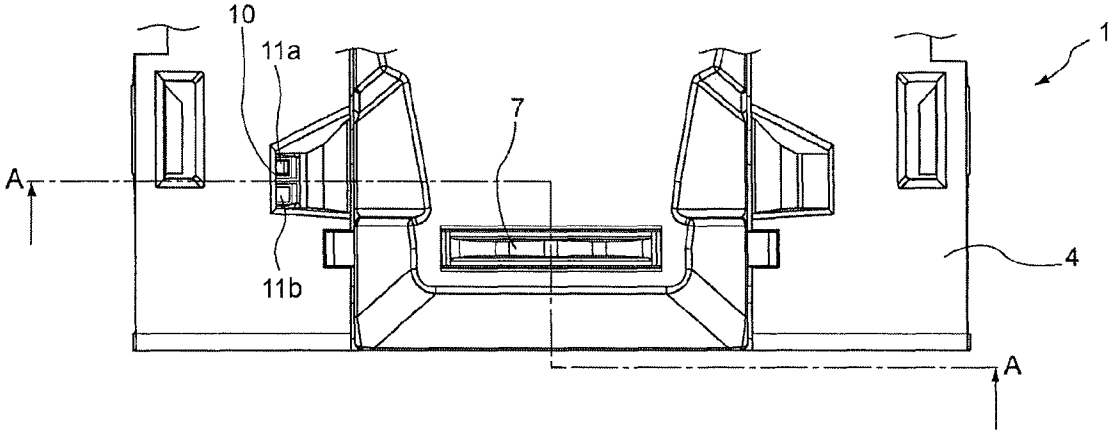
FIGS. 2A and 2B show positions of a clincher and a photo sensor respectively disposed on a table used in the electric stapler. Specifically.
Figure 2B:
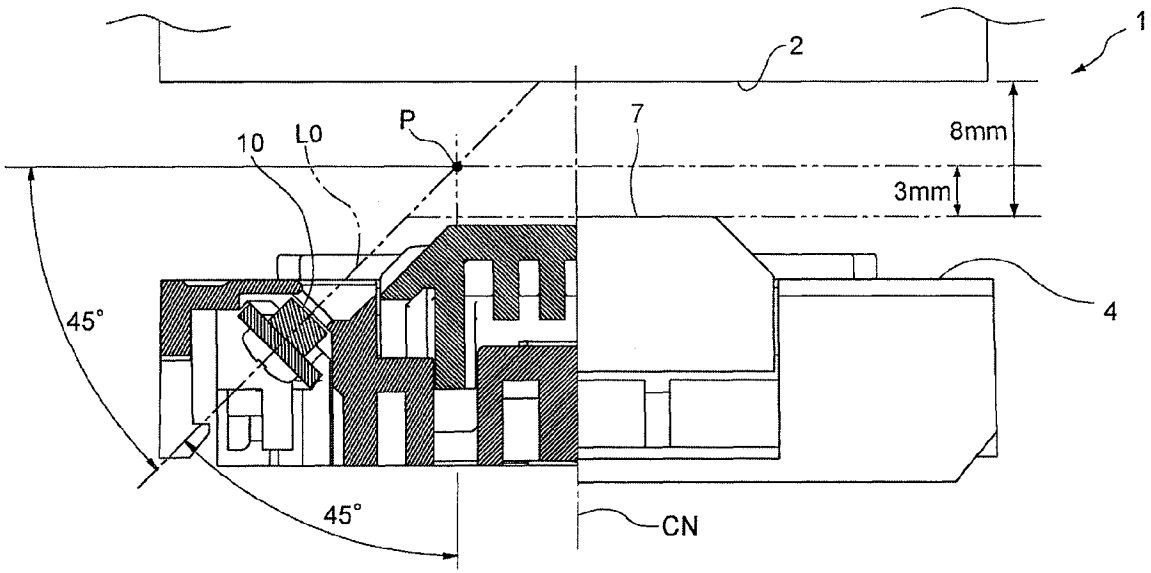

Also, as shown in FIGS. 2A and 2B, the table 4 includes a photo sensor 10 which exists on a left side of the clincher 7 when it is viewed from a front face of the clincher 7. The photo sensor 10 is a reflection type photo interrupter and includes a light emitting portion 11*a* and a light receiving portion 11*b* which are formed integrally with each other.

The photo sensor 10, as shown in FIG. 2A, is disposed adjacent to the clincher 7 in such a manner that, in the case that the photo sensor 10 and the clincher 7 are viewed from the upper face of the table 4, the photo sensor 10 and clincher 7 are arranged horizontally. Also, as shown in FIG. 2B, the photo sensor 10 is set in such a manner that an optical axis L0 of the photo sensor 10 is inclined toward the clincher 7 by an angle of 45 degrees from a horizontal direction or from a vertical direction.

As shown in FIG. 2B, in the electric stapler 1 according to the first exemplary embodiment, in a state before the magazine 2 and driver unit 3 are moved down (in a state where the magazine 2 and driver unit 3 are held at their respective home positions), the distance between the clincher position and magazine 2 is secured to be 8 mm (which is an example; that is, the distance is not limited to 8 mm). On the other hand, a position, at which the paper bundle is inserted, is set for a position which is approximately 3 mm from the horizontal position of the clincher 7 (which is an example; that is, the position is not limited to 3 mm). The photo sensor 10, as described above, is disposed on the table 4 in the 45-degree inclined state, and is also ser such that, in the case that the paper bundle is inserted with the 3 mm position as the reference, a detection point P of the paper bundle is present right above the clincher 7.

In the case that the paper bundle is inserted upwardly of the clincher 7, a radiation light emitted from the light emitting portion 11*a* of the photo sensor 10 is reflected by a face of the paper bundle and is then received by the light receiving portion 11*b* of the photo sensor 10. The receiving of the reflected light (radiation light) by the light receiving portion 11*b* makes it possible for the photo sensor 10 to determine that the paper bundle is inserted upwardly of the clincher 7.

The motor is provided in an interior portion of the electric stapler 1. And, in the case that the existence of the paper bundle is detected by the photo sensor 10, the motor can be driven according to a control of a control portion (control means which is not shown) of a copying machine or a multifunction printer. On an output shaft of the motor, there is provided a link mechanism (not shown) which can be operated according to the driving of the motor. Owing to the link mechanism, the driver unit 3 and magazine 2 can be reciprocated in the vertical direction.

Next, description will be given below of a case in which the thus structured electric stapler 1 is driven as the paper bundle is inserted into the table 4 employed in the electric stapler 1.

Figure 3A:
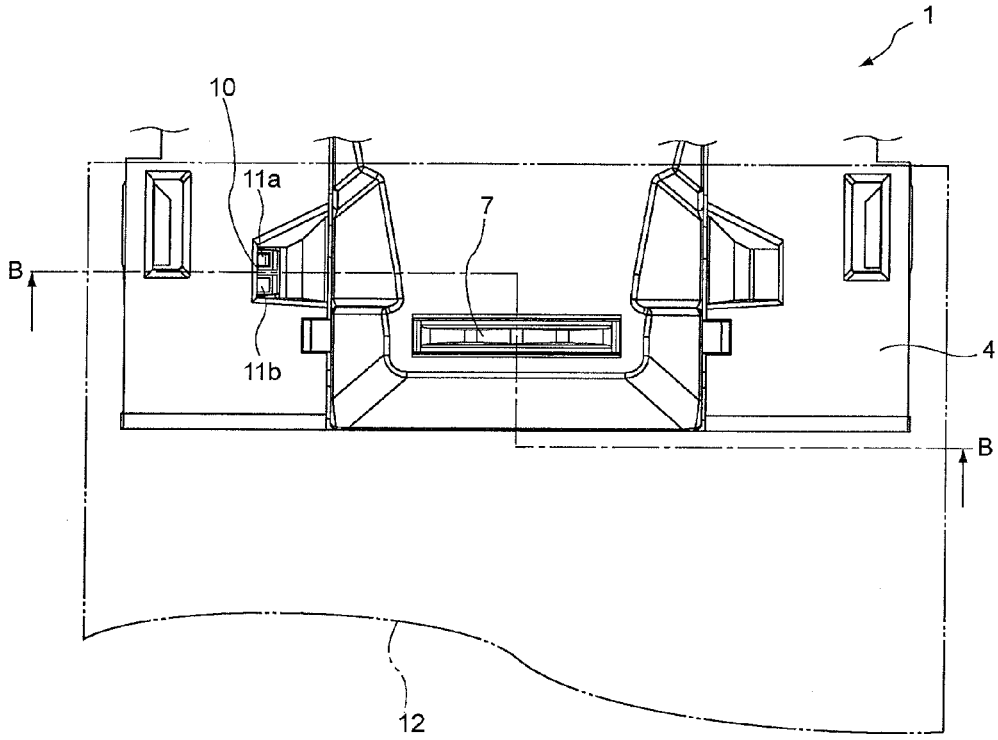
FIGS. 3A and 3B show a state where a paper bundle is inserted into the table of the electric stapler. Specifically.
Figure 3B:
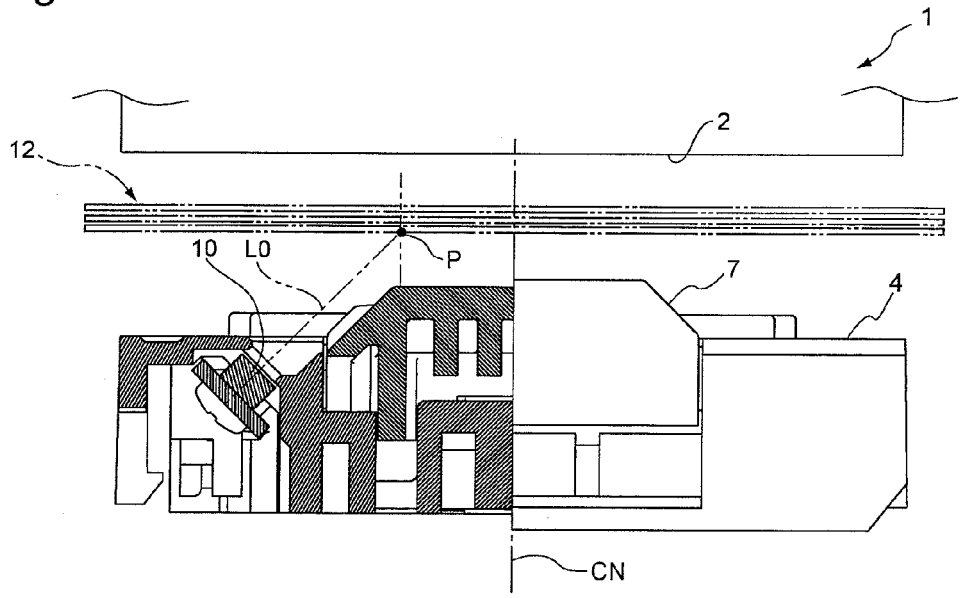

Firstly, in the case that the paper bundle 12 is inserted into the table 4 from the front side of the electric stapler 1, as shown in FIGS. 3A and 3B, the paper bundle 12 arrives at the setting position of the clincher 7. That is, the paper bundle 12 is inserted in such a manner that the paper bundle 12 covers the photo sensor 10 while blocking the radiation light of the photo sensor 10. In the case that the paper bundle 12 is inserted in this manner, the radiation light of the photo sensor 10 is reflected by the paper bundle 12 at the detection point of the photo sensor 10 (a position which exists 3 mm above the setting position of the clincher 7) and the thus reflected radiation light is received by the light receiving portion 11*b*, whereby the existence of the paper bundle 12 can be detected by the photo sensor 10. Information about the insertion of the paper bundle 12 detected by the photo sensor 10 is transmitted to the control portion. The control portion, on receiving the information about the insertion of the paper bundle 12, determines that the paper bundle 12 has been set properly.

In the case that the proper insertion of the paper bundle 12 is determined by the control portion, according to the control of the control portion, the driving of the motor is started to move down the magazine 2 in the direction of the table 4, whereby the magazine 2 and table 4 are allowed to hold the paper bundle 12 therebetween. After then, the driver unit 3 is driven to thereby move down the forming plate. Due to the downward movement of the forming plate, a staple existing at the forming position is bent and formed into a U-shaped staple. At the same time, due to the downward movement of the driver, the thus bent formed staple is pushed out onto the paper bundle 12, whereby the leg portions of the bent formed staple are caused to penetrate through the paper bundle 12.

After then, by pushing out the staple further using the driver, while the crown of the staple is being pressure contacted against the paper bundle 12, the leading end portions of the leg portions of the staple are projected out from the paper bundle 12, and the thus projected leading end portions of the leg portions are deformed inwardly using the clincher 7. When the penetration of the leg portions of the staple through the paper bundle 12 due to the push-out by the driver, the deformation of the staple leg portions, and the binding of the paper bundle 12 by the staple are completed, the driver unit 3 is moved upward and also the magazine 2 is moved in a direction to part away from the table 4 (that is, the magazine 2 is moved upward), thereby ending the paper bundle binding processing.

As described above, in the electric stapler 1 according to the exemplary embodiment, since the photo sensor 10 is disposed adjacent to the lateral side of the clincher 7 in an inclined manner in a state in which the paper bundle detection point P of the photo sensor 10 is set above the setting position of the clincher 7, the state of insertion of the paper bundle 12 into the setting position of the clincher 7 can be detected quickly and positively. This makes it possible to prevent the electric stapler 1 from carrying out the binding operation before the paper bundle 12 arrives at the setting position of the clincher 7 and thus to prevent the staple from being struck idly.

Also, since the photo sensor 10 is disposed adjacent to the lateral side of the clincher 7, when compared with a case in which the photo sensor 10 is disposed on the deep side of the clincher 7, the structure of the electric stapler according to the exemplary embodiment can provide an advantage that it is easy to secure a space for disposing the photo sensor 10.

Further, the photo sensor 10, as shown in FIG. 2A, is disposed adjacent to the clincher 7 in such a manner that, when the photo sensor 10 and clincher 7 are viewed from above, the photo sensor 10 and clincher 7 are arranged in the horizontal direction. Therefore, in the case that the paper bundle 12 is inserted from the upper-stream side of the clincher 7, the paper bundle 12 can be detected by the photo sensor 10 simultaneously when the paper bundle 12 is inserted into a position right above the setting position of the clincher 7. Therefore, since the proper insertion of the paper bundle 12 can be measured quickly and positively by the photo sensor 10, the binding operation can be started with a proper response in linking with the insertion of the paper bundle 12.

Also, since the insertion of the paper bundle 12 in such a manner as to cover the clincher 7 can be detected instantaneously by the photo sensor 10, there is eliminated the need to carry out an operation timing delay processing (which is carried out in the case that a photo sensor is provided on the upper-stream side of the clincher 7) or a similar processing in which the time necessary from the detection of the paper bundle 12 by the photo sensor to the completion of the insertion of the paper bundle 12 is taken into consideration. In this manner, since the binding processing can be quickly executed simultaneously with the detection of the paper bundle 12 by the photo sensor 10, the stability of the binding position can be secured and also the binding processing can be executed more quickly. Further, it is possible to prevent the staple from being struck idly as in the timing delay processing or the like.

Here, as shown in FIG. 2B, according to the first exemplary embodiment, the detection point P (a position existing 3 mm above the setting position of the clincher 7) of the photo sensor 10 is set for a position which is slightly shifted to the left from the central position CN (clincher center) of the clincher 7. However, the detection point of the photo sensor 10 is not limited to the position that is shifted from the clincher center CN in this manner. For example, there may also be employed a structure in which the inclination angle of the photo sensor 10 is set such that the detection point P thereof (the position existing 3 mm above the setting position of the clincher 7) exists right above the clincher center CN. In this structure, by adjusting the optical axis L0 direction of the radiation light, the existence of the paper bundle 12 just above the central portion of the clincher 7 can be detected correctly before the binding processing is started.

Second Exemplary Embodiment

Next, description will be given below of an electric stapler according to a second exemplary embodiment of the invention. In the electric stapler 1 according to the first exemplary embodiment, description has been given of a case in which only one photo sensor 10 is set on the table 4. However, an electric stapler according to the second exemplary embodiment is different from the electric stapler 1 according to the first exemplary embodiment in that it employs two photo sensors. Here, the parts of the second exemplary embodiments having the same structures as those described in the first exemplary embodiment are given the same designations and thus the detailed description thereof is omitted here.

Figure 4A:
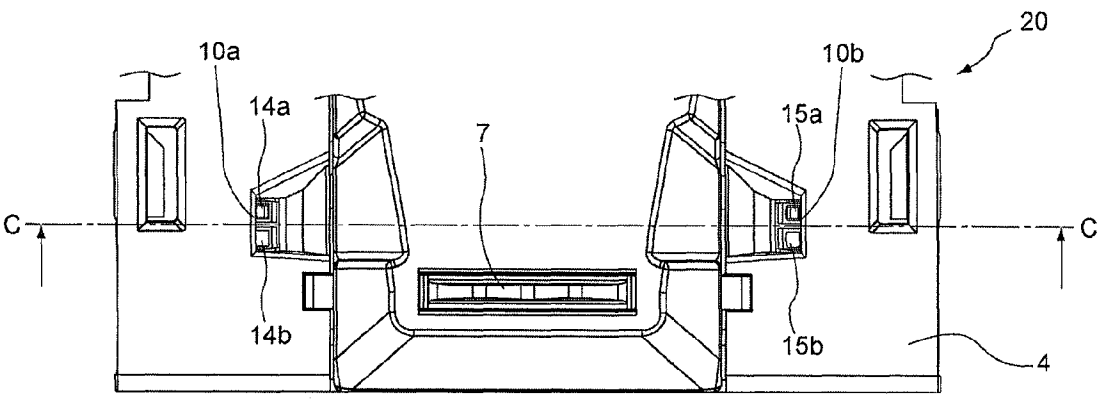
FIGS. 4A and 4B show positions of a clincher and a photo sensor respectively disposed on a table used in an electric stapler according to a second exemplary embodiment of the invention. Specifically.
Figure 4B:
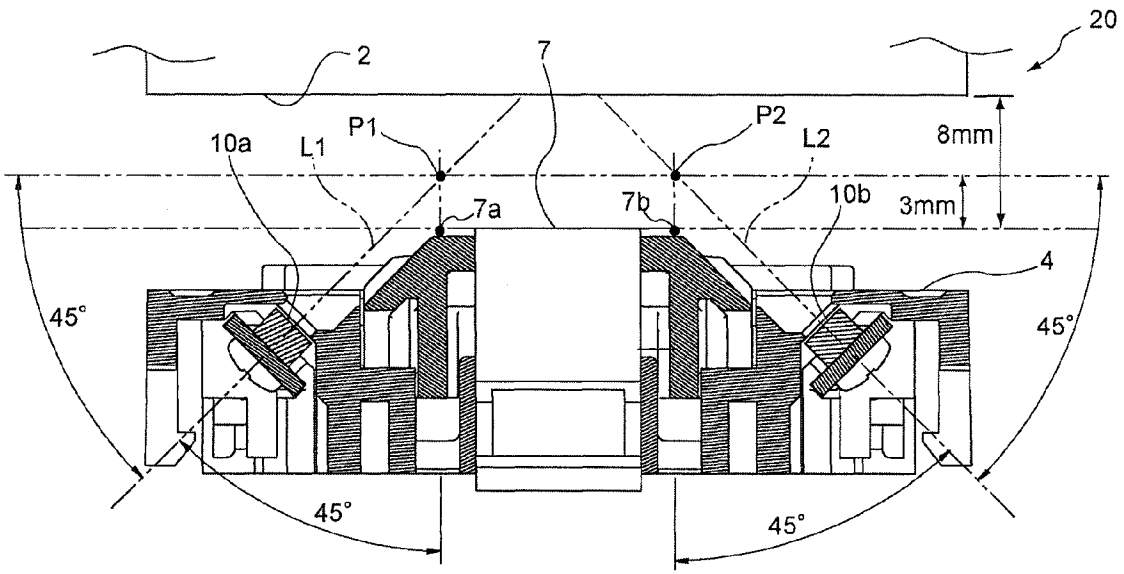

As shown in FIGS. 4A and 4B, on a table 4 used in an electric stapler 20 according to the second exemplary embodiment, there are provided two photo sensors 10*a* and 10*b* respectively at positions adjacent to left and right sides of a clincher 7. The photo sensors 10*a* and 10*b* are respectively photo interrupters of a reflection type. The photo sensor 10*a* includes a light emitting portion 14*a* and a light receiving portion 14*b* which are formed integrally with each other, while the photo sensor 10*b* includes a light emitting portion 15*a* and a light receiving portion 15*b* which are formed integrally with each other.

The photo sensors 10*a* and 10*b*, as shown in FIG. 4A are respectively disposed adjacent to the clincher 7 in a manner in which, in the case that they are viewed from above, the photo sensors 10*a* and 10*b* are arranged in the horizontal direction. Also, the photo sensors 10*a* and 10*b* are set in such a manner that their respective optical axes L1 and L2 are inclined by an angle of 45 degrees toward the direction of the clincher 7 from the horizontal direction or from the vertical direction. As shown in FIGS. 4A and 4B, the detection point P1 of the photo sensor 10*a* disposed on the left of the clincher 7 is set at a position 3 mm above the left end portion 7*a* of the clincher 7 held at its setting position, whereas the detection point P2 of the photo sensor 10*b* disposed on the right of the clincher 7 is set at a position 3 mm above the right end portion 7*b* of the clincher 7 held at its setting position.

Next, description will be given below of a manner of driving of the above structured electric stapler 20 in the case that the paper bundle 12 is inserted into the table 4 of the electric stapler 20.

Figure 5A:
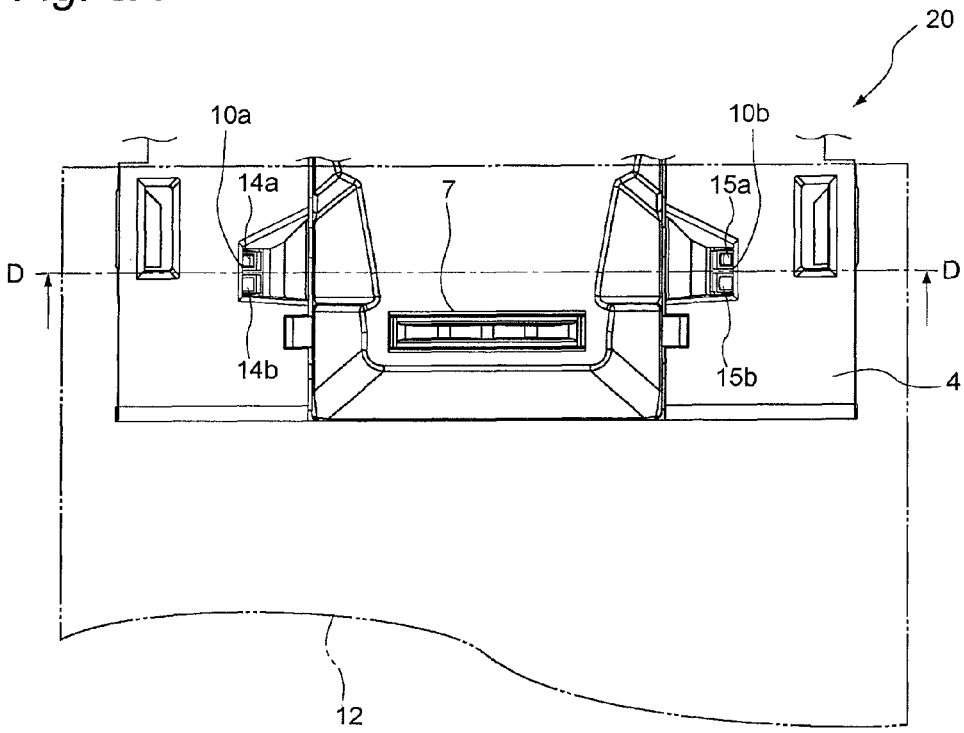
FIGS. 5A and 5B are first views to show a state in which a paper bundle has been inserted into a table used in the electric stapler. Specifically.
Figure 5B:
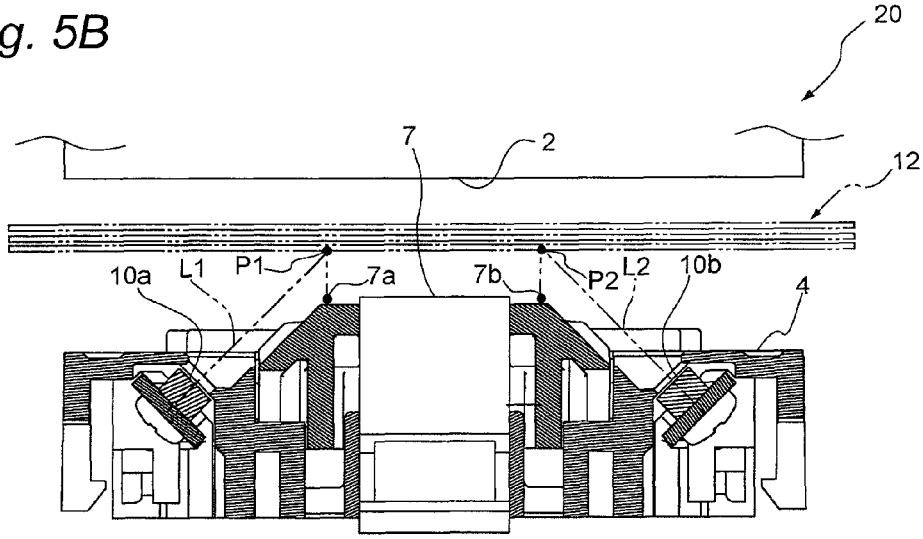

Firstly, when the paper bundle 12 is inserted into the table 4 from the front side of the electric stapler 20 and, as shown in FIGS. 5A and 5B, the paper bundle 12 exists in such a manner that the paper bundle 12 covers the clincher 7, the photo sensor 10*a* and photo sensor 10*b*, the existence of the paper bundle 12 at the detection point P1 (the position existing 3 mm above the left end portion 7*a* of the clincher 7) is detected by the photo sensor 10*a*, while the existence of the paper bundle 12 at the detection point P2 (the position existing 3 mm above the right end portion 7*b* of the clincher 7) is detected by the photo sensor 10*b*. Information about the insertion of the paper bundle 12 detected by the photo sensors 10*a* and 10*b* respectively is transmitted to the control portion from the respective photo sensors 10*a* and 10*b*. On receiving the information about the insertion of the paper bundle 12 from both of the photo sensors 10*a* and 10*b*, the control portion determines that the paper bundle 12 has been set properly and thus the electric stapler 20 is allowed to start the above-mentioned binding processing.

Figure 6A:
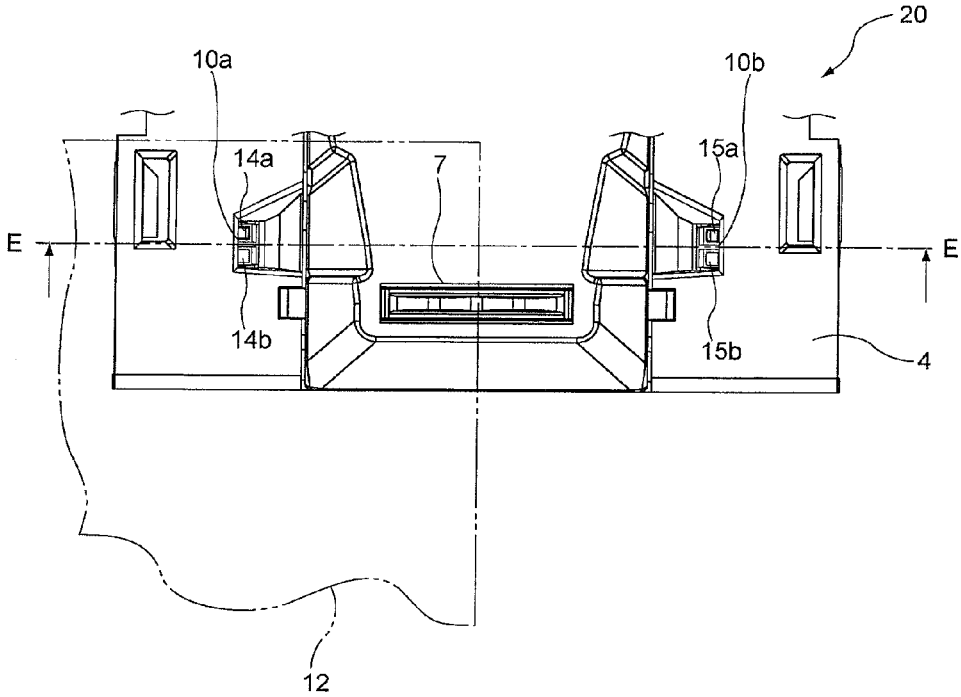
FIGS. 6A and 6B are second views which show a state where the paper bundle is inserted into the table used in the electric stapler. Specifically.
Figure 6B:
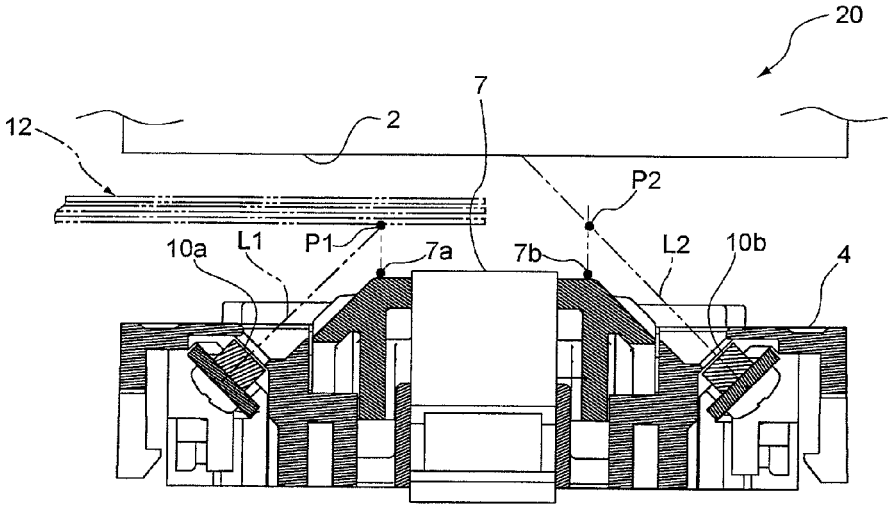

On the other hand, there can appear a situation in which, as shown in FIGS. 6A and 6B, the paper bundle 12 is inserted in such a manner as to cover the photo sensor 10*a* and a portion of the clincher 7 but does not arrive at the photo sensor 10*b* nor the portion of the clincher 7 that exists on the photo sensor 10*b*. Description will be given below of this situation.

In this situation, in the photo sensor 10*a*, since the radiation light of the photo sensor 10*a* is reflected by the paper bundle 12 and is thus detected by the receiving portion 14*b* of the photo sensor 10*a*, the photo sensor 10*a* transmits to the control portion information telling that the paper bundle 12 has been detected. On the other hand, in the photo sensor 10*b*, since the paper bundle 12 does not exist at the detection point P2 of the photo sensor 10*b*, the detection of the paper bundle 12 cannot be made and, therefore, the photo sensor 10*b* does not transmit to the control portion information telling that the paper bundle 12 has been detected.

In this manner, in the case that one photo sensor (one of the photo sensors 10*a* and 10*b*) transmits to the control portion the information telling that the paper bundle 12 has been detected and the other photo sensor (the other of the photo sensors 10*a* and 10*b*) does not transmit to the control portion the information telling that the paper bundle 12 has been detected, the control portion determines that, as shown in FIGS. 6A and 6B, the paper bundle 12 has not been inserted fully in the right and left directions of the clincher 7 nor has the paper bundle 12 been set properly (that is, the control portion determines that the paper bundle 12 is being inserted to the clincher 7 or the paper bundle 12 is being pulled out therefrom).

Thus, in the case that the control portion receives the information about the insertion of the paper bundle 12 only from one of the photo sensors 10*a* and 10*b*, the control portion determines that the paper bundle 12 is not set properly and thus does not allow the execution of the binding operation. That is, since, in the case that the information is transmitted to the control portion only from one of the photo sensors 10*a* and 10*b*, the control portion does not allow the execution of the binding operation, it is possible to prevent the execution of a binding operation in a state in which the paper bundle 12 is not inserted fully with respect to the clincher 7; and thus, it is possible to prevent the paper bundle 12 from being bound at an improper position (that is, in an improper state).

Also, since the paper bundle 12 is detected using both of the photo sensors 10*a* and 10*b*, the insertion state of the paper bundle 12 (whether the paper bundle 12 has been inserted into only a portion of the clincher 7, or whether the paper bundle 12 has been inserted in such a manner as to cover the whole of the clincher 7) can be confirmed correctly. Therefore, even in the case that the insertion direction of the paper bundle 12 or the inserting speed thereof varies, the state of the paper bundle 12 can be determined correctly and thus the binding operation can be carried out quickly and positively.

Further, in the electric stapler 20 according to the second exemplary embodiment, since the insertion state of the paper bundle 12 can be checked certainly, differently from a structure in which a photo sensor is disposed on the upper-stream side of the clincher 7, there is eliminated the need to carry out an operation timing delay processing which gives consideration to the time necessary from the detection of the paper bundle 12 to the insertion of the paper bundle 12 up to the deep side of the clincher 7. It can speed up the binding processing and also can prevent a staple from being struck idly due to the execution of the operation timing delay processing.

Now, description has been given specifically of the electric staplers respectively according to the first and second exemplary embodiments of the invention with reference to the accompanying drawings. However, the electric stapler is not limited to those illustrated in the first and second exemplary embodiments. It is obvious to those skilled in the art that various changes and modifications are possible without departing from the scope of the appended patent claims, and also that such changes and modifications naturally fall within the technological scope of the invention.

For example, in the electric stapler 1 according to the first exemplary embodiment, description has been given of a case in which only one photo sensor 10 is used; and, in the electric stapler 20 according to the second exemplary embodiment, description has been given of a case in which two photo sensors constituted of the photo sensors 10*a* and 10*b* are used. However, the number of photo sensors used is not limited to one or two, but it may be three or more.

Also, in the electric staplers 1 and 20 respectively according to the first and second exemplary embodiments, description has been given of the structures in which the photo sensor 10, or the photo sensors 10*a* and 10*b* are set on the table 4. However, the photo sensor may not always be set on the table but it may also be set on the driver unit.

Third Exemplary Embodiment

Now, description will be given specifically of an electric stapler 30 according to a third exemplary embodiment of the invention. Here, the parts of the third exemplary embodiment having the same structures as those described in the first exemplary embodiment are given the same designations and thus the detailed description thereof is omitted here.

Figure 7A:
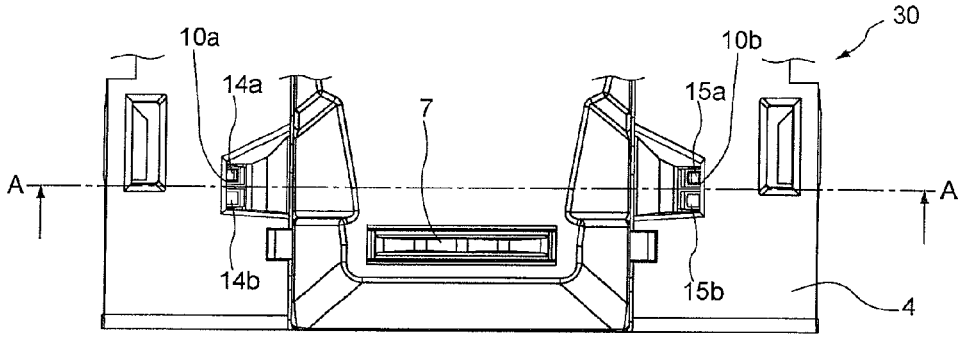
FIGS. 7A and 7B show positions of a clincher and two photo sensors respectively disposed on a table used in an electric stapler according to a third exemplary embodiment of the invention. Specifically.
Figure 7B:
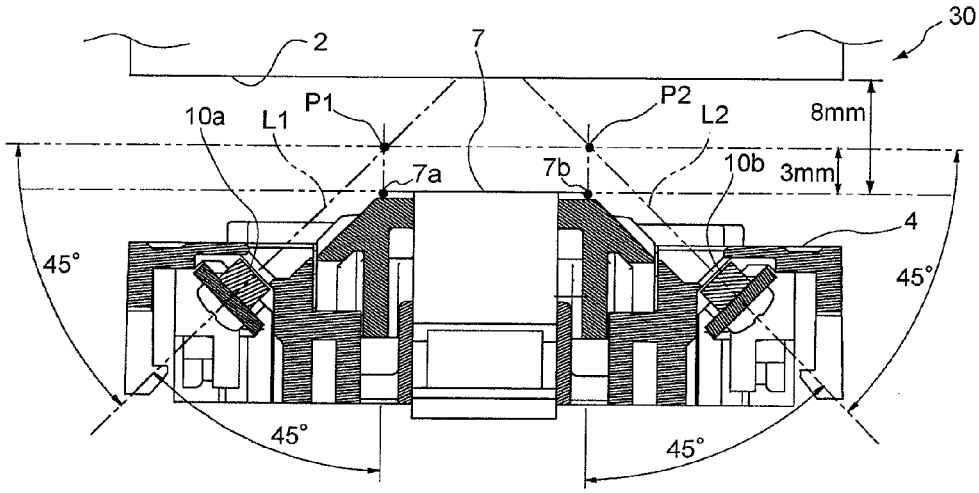

As shown in FIGS. 7A and 7B, two photo sensors 10*a* and 10*b* are disposed at two positions which respectively exist adjacent to the left and right sides of the clincher 7 when the table 4 is viewed from the front side thereof. The two photo sensors 10*a* and 10*b* are respectively made of a reflection type photo interrupter. Specifically, the photo sensor 10*a* includes a light emitting portion (first light emitting means) 14*a* and a light receiving portion 14*b* (first light receiving means) which are formed integrally with each other; and, the photo sensor 10*b* includes a light emitting portion (second light emitting means) 15*a* and a light receiving portion 15*b* (second light receiving means) which are formed integrally with each other.

The photo sensors 10*a* and 10*b*, as shown in FIG. 7A, are disposed respectively adjacent to the clincher 7 in such a manner that the photo sensor 10*a*, clincher 7 and photo sensor 10*b* are arranged in the horizontal direction when they are viewed from above. Also, the respective photo sensors 10*a* and 10*b*, as shown in FIG. 7B are set in such a manner that their respective optical axes L1 and L2 are inclined toward the clincher 7 by an angle of 45 degrees from the horizontal direction or from the vertical direction.

In the electric stapler 30 according to the third exemplary embodiment, in a state before the magazine 2 and driver unit 3 are moved downward (that is, in a state where they are held in their respective home positions), the distance from the position of the clincher to the magazine 2 and driver unit 3 is secured to be 8 mm (which is an example, that is, the distance is not limited to 8 mm). On the other hand, a position, from which the paper bundle is inserted, is set at a height position which exists approximately 3 mm (which is an example: that is, the height position is not limited to 3 mm) above the horizontal position of the clincher 7.

As shown in FIG. 7B, in the photo sensor 10*a* which is disposed on the left side of the clincher 7, there is set a paper bundle detection point P1 at a position which exists 3 mm above the left end portion 7*a* of the clincher 7 held at the setting position thereof and, in the photo sensor 10*b* disposed on the right side of the clincher 7, there is set a paper bundle detection point P2 at a position which exists 3 mm above the right end portion 7*b* of the clincher 7 held at the setting position thereof, in order for these detection points P1 and P2 to correspond to the insertion position of the paper bundle (the position existing approximately 3 mm above the horizontal position of the clincher 7).

The photo sensors 10*a* and 10*b* employ a light modulation method. The light modulation method is a method in which light emitting devices (LED) provided in the light emitting portions 14*a* and 15*a* are blinked in a given cycle and there are detected output values which are obtained when a high-pass filter is applied to the output values of the reflected lights received by the light receiving portions 14*b* and 15*b*, thereby checking whether the paper bundle is present or not.

Figure 8A:
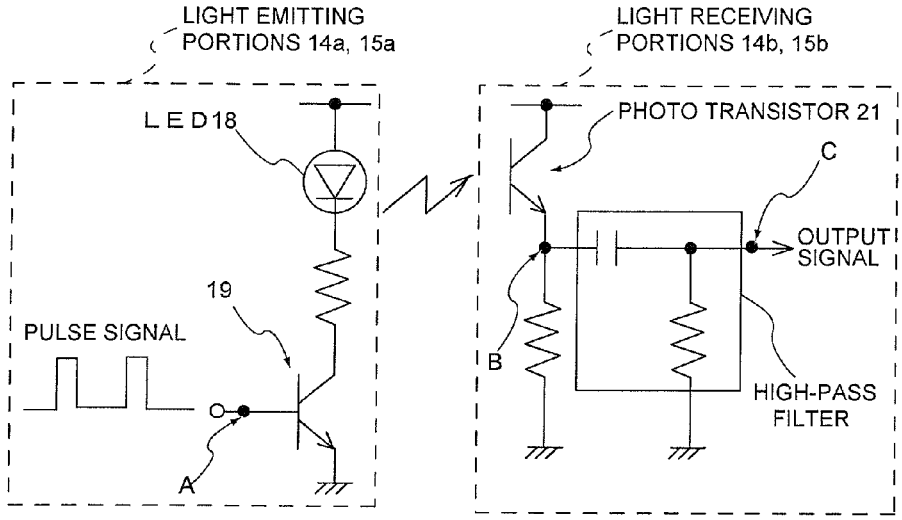
FIG. 8A is a circuit diagram showing a schematic structure of each of the photo sensors used in the electric stapler according to the third exemplary embodiment.

FIG. 8A is a schematic view of the structures of the light emitting portions 14*a* and 15*a* of the photo sensors 10*a* and 10*b* employing the above-mentioned light modulation method. The light emitting portions 14*a* and 15*a* of the photo sensors 10*a* and 10*b* are generally made of an LED 18 and a transistor 19 respectively. With respective to the transistor 19, there is output a pulse signal which is output in a given cycle under the control of the control portion; and, in correspondence to the change of the state of this pulse signal (the high/low state change), the LED 18 can be made to blink and emit the light at a given blinking timing.

On the other hand, the light receiving portions 14*b* and 15*b* of the photo sensors 10*a* and 10 are generally made of a photo transistor 21 and a high-pass filter 22 respectively. A reflected light (a radiation light, a pulse light) received by the photo transistor 21 is detected as a signal, and the thus detected signal is sent to the high-pass filter 22, where the low frequency component of the signal is removed therefrom and the external irregular reflected light of the signal is thereby removed therefrom. After then, the resultant signal is detected as the output signal of the light receiving portions 14*b* and 15*b*.

Figure 8B:
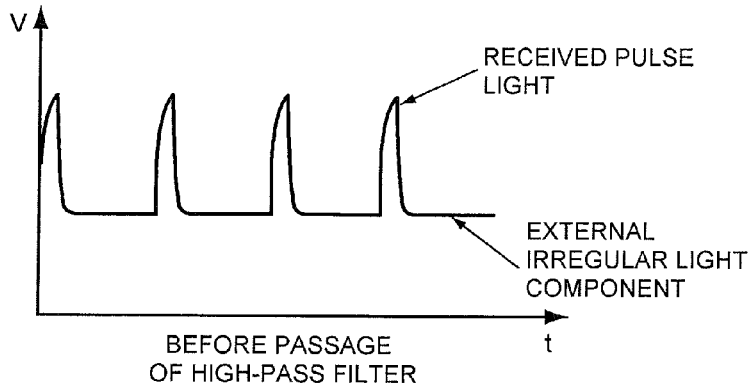
FIG. 8B is a graphical representation showing variations in an output signal of the light receiving portion of the photo sensor before a high-pass filter is applied to a photo transistor which is included in the photo sensor and is shown in FIG. 8A.
Figure 8C:
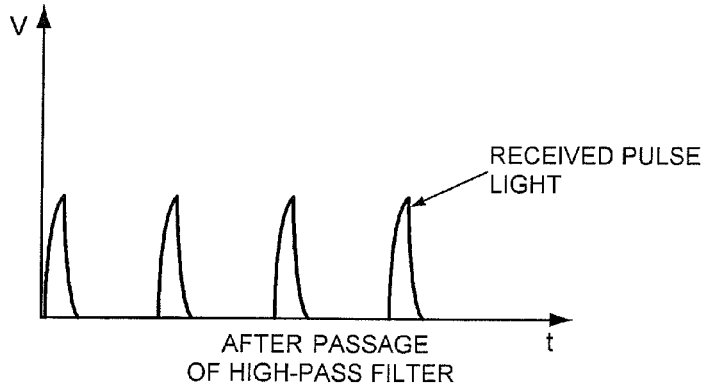
FIG. 8C is a graphical representation showing variations in the output signal of the light receiving portion of the photo sensor after the high-pass filter is applied to the photo transistor which is included and is shown in FIG. 8A.

FIG. 8B is a graphical representation showing variations in the output signal before the high-pass filter 22 is applied to the output signal (before the output signal passes through the high-pass filter). And, FIG. 8C is a graphical representation showing variations in the output signal after the high-pass filter 22 is applied to the output signal (after the output signal passes through the high-pass filter). As can be seen clearly from the comparison between the graphical representations of FIGS. 8B and 8C, the signal, before the high-pass filter 22 is applied thereto, shows a value which includes the value of the received radiation light (pulse light) and the value of the external irregular light component. On the other hand, in the signal after the high-pass filter 22 is applied thereto (after the signal passes through the high-pass filter), since there is removed the external irregular light component that is added to the signal before the high-pass filter 22 is applied thereto (before the signal passes through the high-pass filter), it is possible to extract only the output signal of the reflected light (radiation light, pulse light) that has been received by the receiving portions. The output signal, which has been extracted by the light receiving portions 14*b* and 15*b* in this manner, is then transmitted to the control portion.

FIGS. 9A to 9D are respectively views showing the following output signals which are output under the control of the control portion. That is, a pulse signal which is output to the light emitting portion 14*a* of the photo sensor 10*a* (a pulse signal which is output to the light emitting portion 14*a* and exists at a point "A" shown in FIG. 8A; see FIG. 9A); a pulse signal which is output to the light emitting portion 15*a* of the photo sensor 10*b* (which is output to the light emitting portion 15*a* and exists at the point "A" shown in FIG. 8A; see FIG. 9B); the output of the photo transistor 21 which is detected by the light receiving portion 15*b* of the photo sensor 10*b* in a state where the paper bundle is not inserted yet (an output signal which is output to the light receiving portion 15*b* and exists at a point "B" shown in FIG. 8A; see FIG. 9C); and, the output of the photo transistor 21 which is detected by the light receiving portion 15*b* of the photo sensor 10*b* in a state where the paper bundle is not inserted yet, after the high-pass filter 22 is applied to the output of the photo transistor 21 (an output signal which is output to the light receiving portion 15*b* and exists at a point "C" shown in FIG. 8A; see FIG. 9D).

The control portion of the electric stapler 30 according to the third exemplary embodiment carries out a pulse signal control operation in which an output signal to be output to the light emitting portion 14*a* of the photo sensor 10*a* and a pulse signal to be output to the light emitting portion 15*a* of the photo sensor 10*b* are perfectly reversed in phase to each other (that is, in the case that the pulse signal to be output to the light emitting portion 14*a* has a positive phase, the pulse signal to be output to the light emitting portion 15*a* is made to have a negative phase).

Here, an output structure for outputting a pulse signal to the LED 18 can be constituted simply using an inverter circuit while using the timer output port of a microcomputer or the like which constitutes the control portion. Therefore, the output structure is simple, can reduce a space necessary for disposing a substrate, and prevent an increase in the cost thereof.

Figure 9A:
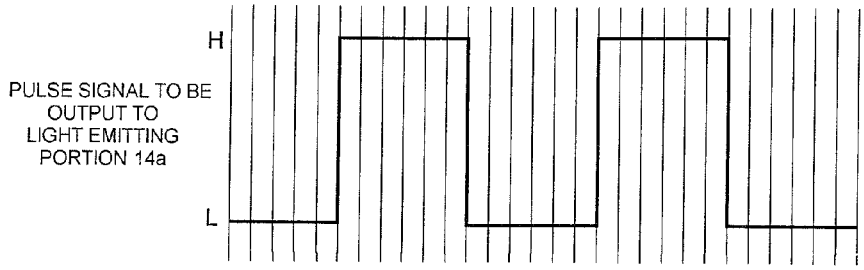
FIG. 9A shows a pulse signal which is output to one of the photo sensors according to the third exemplary embodiment.
Figure 9B:
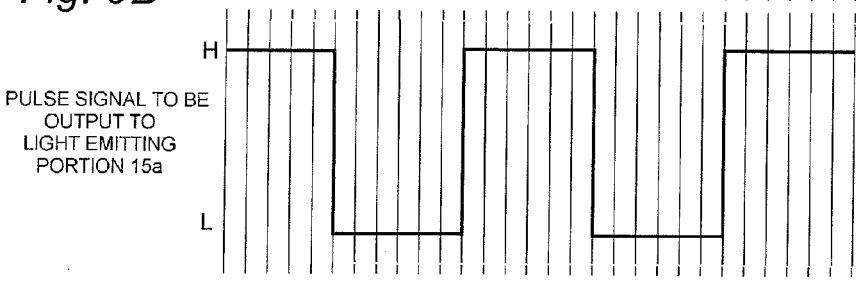
FIG. 9B shows a pulse signal which is output to the other photo sensor.
Figure 9C:
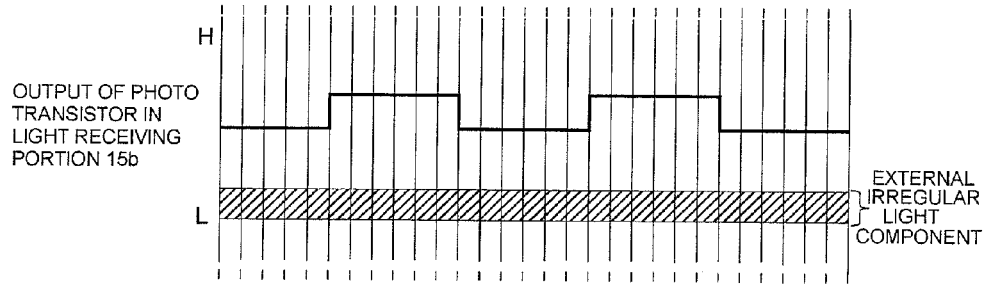
FIG. 9C shows variations in the output signal of a photo transistor before a high-pass filter is applied to the output of the photo transistor.

As shown in FIGS. 9A and 9B, when the pulse signals of the light emitting portions 14*a* and 15*a* are reverse in phase to each other, a light emitted from the light emitting portion 15*a* of the photo sensor 10*b* and reflected by the magazine 2 (a reflected light) and a light emitted from the light emitting portion 14*a* of the photo sensor 10*a* and reflected by the magazine 2 (a reflected light) are detected by the light receiving portion 15*b* of the photo sensor 10*b* in such a manner that these two reflected lights are synthesized (combined) together. When the reflected light (radiation light) of the light emitting portion 14*a* and the reflected light (radiation light) of the light emitting portion 15*a* are synthesized together in this manner, since the pulse signals of the respective radiation lights are reverse in phase to each other, the respective peaks of the pulse signals are cancelled relative to each other to thereby synthesize a signal. As a result, the output of the photo transistor 21 to be detected by the light receiving portion 15*b* of the photo sensor 10*b* (an output signal which is output to the light receiving portion 15*b* and exists at the point "B" shown in FIG. 8A), as shown in FIG. 9C, provides a signal in which a difference between the high (H) and low (L) thereof is reduced.

Figure 9D:
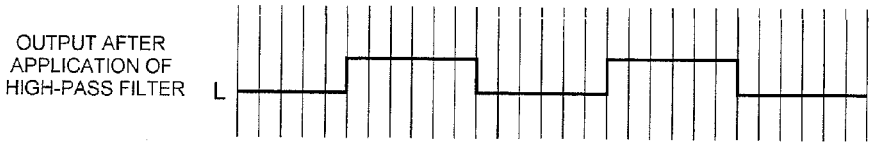
FIG. 9D shows variations in the output signal of the photo transistor after the high-pass filter is applied to the output of the photo transistor, while FIG. 9D also shows a case in which the pulse signal shown in FIG. 9A and the pulse signal shown in FIG. 9B are reversed in phase.

Here, the output of the photo transistor 21 detected by the light receiving portion 15*b* of the photo sensor 10*b* (the output signal which is output to the light receiving portion 15*b* and exists at the point "B" shown in FIG. 8A) is influenced by the external irregular light and is thereby shifted to a higher value. Therefore, in the case that the high-pass filter 22 is applied to the output of the photo transistor 21 detected by the light receiving portion 15*b* of the photo sensor 10*b* (the output signal which is output to the light receiving portion 15*b* and exists at the point "B" shown in FIG. 8A), as shown in FIG. 9D, the influence of the external irregular light can be removed. The output of the photo transistor 21 after the high-pass filter 22 is applied thereto (the output signal which is output to the light receiving portion 15*b* and exists at the point "C" shown in FIG. 8A), as shown in FIG. 9D, is detected as a pseudo-DC output state, that is, as an output value in which the high/low change thereof is reduced.

On the other hand, in the case that the paper bundle is inserted into the table 4, since the radiation light emitted from the light emitting portion 14*a* of the photo sensor 10*a* is blocked by the paper bundle, the radiation light is prevented from arriving at the light receiving portion 15*b* of the photo sensor 10*b*. The light to be detected by the light receiving portion 15*b* is only the light (reflected light) that is obtained when the radiation light emitted from the light emitting portion 15*a* is reflected by the paper bundle. Therefore, the state of the output of the photo transistor 21, which is detected by the light receiving portion 15*b*, shows variations corresponding to the pulse signal output from the control portion to the light emitting portion 15*a* (more specifically, the blinking timings of the light emitting portion 15*a* which is caused to blink according to the pulse signal). Accordingly, the output, the external irregular light component of which has been removed due to application of the high-pass filter 22 thereto, is detected as a pseudo-AC output state corresponding to the signal state of the pulse signal output to the light emitting portion 15*a* (see FIG. 9B), that is, as an output value in which the high and low change thereof appears remarkably.

As described above, according to the pulse signals that are reverse in phase to each other, the control portion controls the photo sensors 10*a* and 10*b* such that the photo sensors 10*a* and 10*b* blink the radiation light of the light emitting portion 14*a* and the radiation light of the light emitting portion 15*a* respectively, and applies the high-pass filter 22 to the output signals received respectively by the light receiving portions 14*b* and 15*b* to check the output states of the output signals after the external irregular light components thereof are removed therefrom, thereby confirming the presence or absence of the paper bundle.

As described above, in the case that the output state after application of the high-pass filter 22 is a pseudo DC state, the control portion determines that the reflected light (radiation light) of the light emitting portion 14*a* (or light emitting portion 15*a*) of the photo sensor 10*a* (or photo sensor 10*b*) and the reflected light (radiation light) of the light emitting portion 15*a* (or light emitting portion 14*a*) have been detected by the light receiving portion 15*b* (or light receiving portion 14*b*) in the mutually synthesized state. That is, the control portion determines that the paper bundle has not been inserted, and thus it does not carry out a binding processing which will be discussed later.

On the other hand, in the case that the output state after application of the high-pass filter 22 is a pseudo AC state, the control portion determines that the reflected light (radiation light) of the light emitting portion 14*a* (or light emitting portion 15*a*) of the photo sensor 10*a* (or photo sensor 10*b*) and the reflected light (radiation light) of the light emitting portion 15*a* (or light emitting portion 14*a*) have not been synthesized together but only the radiation light of the light emitting portion 15*a* (or light emitting portion 14*a*) has been reflected by the paper bundle and has been detected by the light receiving portion 15*b* (or light receiving portion 14*b*). That is, the control portion determines that the paper bundle has been inserted, and thus it carries out the binding processing to be discussed later.

When the control portion determines that the paper bundle is inserted, the paper bundle is inserted in such a manner that, while blocking the radiation light of the photo sensor 10*a* and the radiation light of the photo sensor 10*b*, it covers the photo sensor 10*a*, clincher 7 and photo sensor 10*b*. When the paper bundle is inserted in this manner, the driving of the motor is started according to the control of the control portion to move down the magazine 2 in the direction of the table 4, whereby the paper bundle is held by and between the magazine 2 and table 4. After then, as the driver unit 3 is driven and the forming table is thereby moved down, a staple situated at the forming position is bent formed into a U-like shape and also, due to the downward movement of the driver, the staple is pushed out to the paper bundle, whereby the leg portions of the bent formed staple are allowed to penetrate through the paper bundle.

After then, as the staple is further pushed out by the driver, while the crown of the staple is being pressure contacted with the paper bundle, the end portions of the leg portions of the staple are projected out from the paper bundle, and the leading end portions of the thus projected leg portions of the staple are deformed inwardly using the clincher 7. When the penetration and deformation of the leg portions of the staple due to the push-out force of the driver are completed, and thus when the binding of the paper bundle by the staple is completed, the driver unit 3 is moved upward and also the magazine 2 is moved in a direction to part away from the table 4 (that is, the magazine 2 is moved upward), which ends the paper bundle binding processing.

In this manner, in the control portion of the electric stapler 30 according to the third exemplary embodiment, the pulse signal of the radiation light emitted from the light emitting portion 14*a* of the photo sensor 10*a* and the pulse signal of the radiation light emitted from the light emitting portion 15*a* of the photo sensor 10*b* are set such that they are reverse in phase to each other. In the case that the light emitting portions 14*a* and 15*a* of the respective photo sensors 10*a* and 10*b* are allowed to emit their respective radiation lights blinkingly and the output states of the output signals after application of a high-pass filter are detected by the light receiving portions 14*b* and 15*b* of the respective photo sensors 10*a* and 10*b* respectively provide a pseudo AC state, the control portion determines that the paper bundle has been inserted; whereas, in the case that the output states after application of a high-pass filter respectively provide a pseudo DC state, the control portion determined that the paper bundle has not been inserted.

In the case that the pulse signal of the radiation light emitted from the light emitting portion 14*a* of the photo sensor 10*a* and the pulse signal of the radiation light emitted from the light emitting portion 15*a* of the photo sensor 10*b* are set reverse in phase to each other in this manner, even when both of the radiation lights are interfered, the detection sensitivities (S/N ratios) of the light receiving portions 14*b* and 15*b* can be enhanced and thus the presence or absence of the paper bundle can be detected with high accuracy.

Also, even when the paper bundle does not exist but the radiation lights are both interfered, due to the pseudo DC state, the absence of the paper bundle can be detected with high accuracy, thereby eliminating the need to carry out a processing (for example, a processing for forming an uneven portion in the lower face of the magazine 2, or a processing for forming a hole in such face) which can reduce the reflection efficiency of the lower face of the magazine 2 for avoiding such interference.

Also, suppose a situation in which, since the distance between the table 4 and magazine 2 is short, when the light reflected by the magazine 2 is detected by the light receiving portions 14*b* and 15*b*, there is a fear that the magazine 2 can be detected in error as the paper bundle. However, even in this situation, in the case that the paper bundle does not exist, due to the interference of both radiation lights, the output state to be detected by the light receiving portions 14*b* and 15*b* provides a pseudo DC state; and, in the case that the paper bundle exists, the output state provides a pseudo AC state. Therefore, by confirming the output states of the light receiving portions

14*b* and 15*b*, the wrong detection of the magazine 2 for the paper bundle can be prevented.

Here, in the electric stapler 30 according to the third exemplary embodiment, as shown in FIGS. 9A and 9B, since it is necessary to output pulse signals, which are to be reverse in phase to each other, to the respective light emitting portions 14*a* and 15*a*, there must be provided at least two light emitting portions. On the other hand, as a light receiving portion which is required to receive the synthesized reflected light (radiation light), there is necessary only one of the light receiving portions 14*b* and 15*b*. In the case that the control portion checks according to the output state detected by one of the receiving portions 14*b* and 15*b* whether the output state of the reflected light is a pseudo DC state or a pseudo AC state, the existence of the paper bundle can be determined. Therefore, even a structure employing only one light receiving portion can provide the effect of the electric stapler 30 according to the third exemplary embodiment.

Figure 10A:
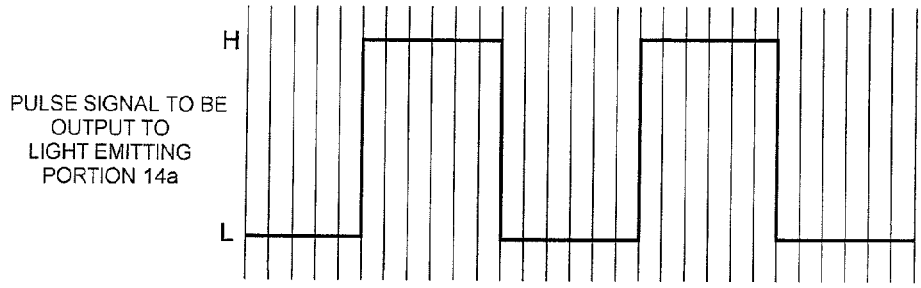
FIG. 10A shows a pulse signal which is output to one of the two photo sensors according to the third exemplary embodiment.
Figure 10B:
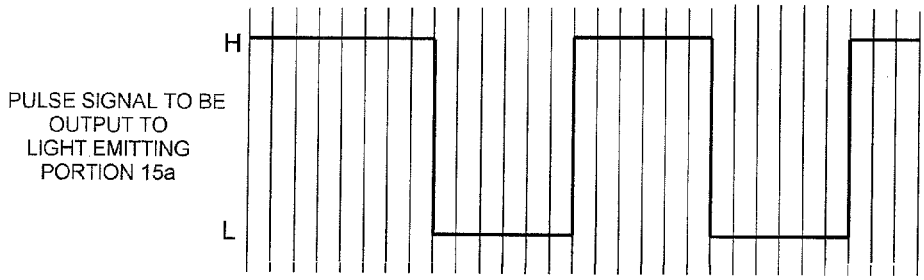
FIG. 10B shows a pulse signal which is output to the other photo sensor.

Also, the above-mentioned pulse signals to be output to the light emitting portions 14*a* and 15*a* are not always limited to the pulse signals that are completely reverse in phase to each other. For example, as shown in FIGS. 10A and 10B, pulse signals, which are to be output to the light emitting portions 14*a* and 15*a*, may also be out of phase with each other by a half cycle. In the case that pulse signals, which are out of phase by a half cycle in this manner, are output to the light emitting portions 14*a* and 15*a*, as shown in FIG. 10C, the output state of the photo transistor 21 to be received by the light receiving portion 15*b* provides a multi-stage AC state.

Figure 10C:
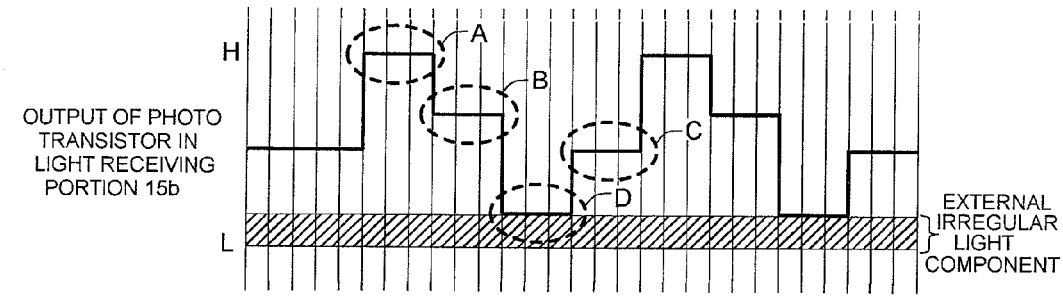
FIG. 10C shows variations in the output signal of the photo sensor before a high-pass filter is applied to the output of the photo transistor of the photo transistor.

Of the output state of the photo transistor 21 shown in FIG. 10C, the portion showing the highest output state (an "A" portion shown in FIG. 10C) shows a state in which the pulse signals of the light receiving portions 14*a* and 15*a* are both high. And, the portion, which shows the second highest output state (a "B" portion shown in FIG. 10C), shows a state in which the pulse signal of the light emitting portion 14*a* is high and the pulse signal of the light emitting portion 15*a* is low; the portion, which shows the third highest output state (a "C" portion shown in FIG. 10C), shows a state in which the pulse signal of the light emitting portion 15*a* is high and the pulse signal of the light emitting portion 14*a* is low; and, the portion showing the lowest output state (a "D" portion shown in FIG. 10C) shows a state in which the pulse signals of the light receiving portions 14*a* and 15*a* are both low.

Figure 10D:
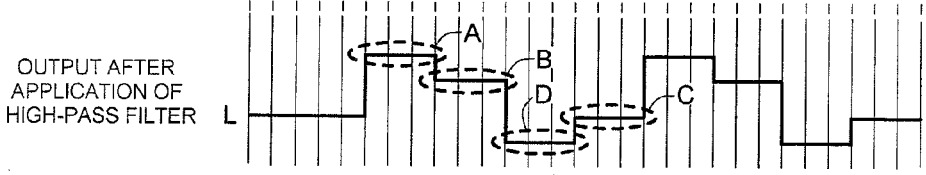
FIG. 10D shows variations in the output signal of the photo sensor after the high-pass filter is applied to the output of the photo transistor of the photo sensor, while FIG. 10D also shows a case in which the pulse signal shown in FIG. 10A and the pulse signal shown in FIG. 10B are different by a half cycle in phase from each other.

Here, since the output state of the photo transistor 21 shown in FIG. 10C contains the influence of the external irregular light component, the output value thereof provides a relatively high value. Therefore, in the case that the high-pass filter 22 is applied to the pulse signals, as shown in FIG. 10D, there can be provided a state which excludes the influence of the external irregular light component, that is, a pseudo AC state in which the output state varies in the above-mentioned four stages.

As described above, even in the case that the pulse signal to be output to the light emitting portion 14*a* and the pulse signal to be output to the light emitting portion 15*a* are out of phase with each other by a half cycle, when the paper bundle does not exist, the pulse signal to be detected by the light emitting portion 15*b* provides a pseudo AC state including the four stages; and, when the paper bundle exists, there is provided a pseudo AC state which corresponds to the pulse signal (see FIG. 10B) output in the light emitting portion 15*a*. Therefore, according to the respective state changes, the existence of the paper bundle can be detected and determined positively.

Figure 11A:
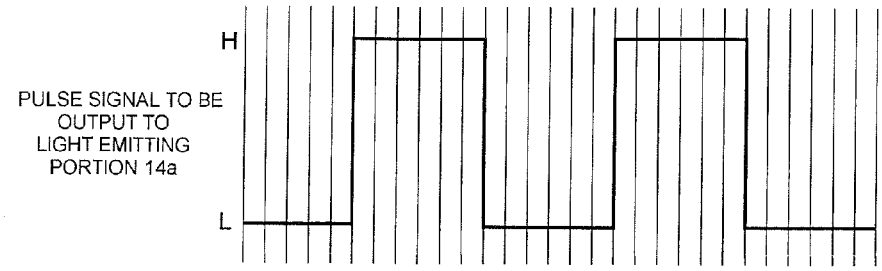
FIG. 11A shows a pulse signal which is output to one of the two photo sensors according to the third exemplary embodiment.
Figure 11B:
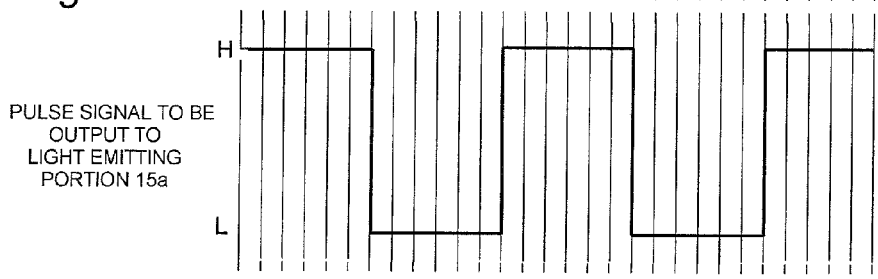
FIG. 11B shows a pulse signal which is output to the other photo sensor.
Figure 11C:
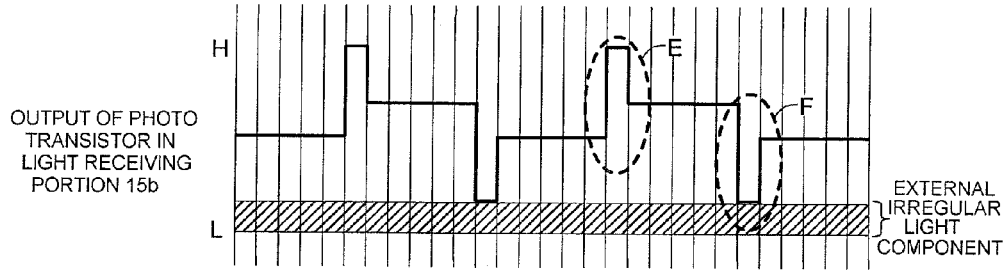
FIG. 11C shows variations in the output signal of the photo sensor before a high-pass filter is applied to the output of the photo transistor of the photo sensor.
Figure 11D:
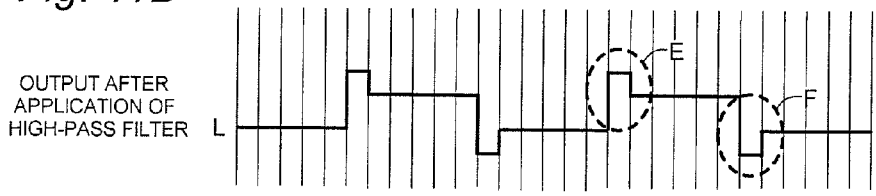
FIG. 11D shows variations in the output signal of the photo sensor after the high-pass filter is applied to the output of the photo transistor of the photo sensor, while FIG. 11D also shows a case in which the pulse signal shown in FIG. 11A and the pulse signal shown in FIG. 11B are slightly different in phase from each other.

Also, as shown in FIGS. 11A and 11B, the pulse signals to be output to the light emitting portions 14*a* and 15*a* may also be pulse signals which are slightly out of phase with each other. Suppose a situation in which the thus slightly phase shifted pulse signals are respectively output to the light emitting portions 14*a* and 15*a*. In this situation, as shown in FIG. 11C, in the case that the pulse signals of the light emitting portions 14*a* and 15*a* are both high, an output value to be detected by the transistor 19 shows an outstandingly high value (peak) only for a short time ("E" portions respectively shown in FIGS. 11C and 11D); whereas, in the case that the pulse signals of the light emitting portions 14*a* and 15*a* are both low, an output value to be detected by the transistor 19 shows an outstandingly low value (bottom) only for a short time ("F" portions respectively shown in FIGS. 11C and 11D).

In the case that there are detected a high value (peak) and a low value (bottom) by finding the high value (peak) and low value (bottom) from the output state detected by the light receiving portion 15*b*, it can be determined that the paper bundle has not been inserted; whereas, in the case that there are not detected the high value (peak) nor low value (bottom) but in the case that an output state corresponding to the pulse signal (see FIG. 11B) output to the light emitting portion 15*a* is detected by the light receiving portion 15*b*, it is possible to determine that the paper bundle has been inserted.

Although description has been given heretofore specifically of the electric stapler 30 according to the third exemplary embodiment with reference to the accompanying drawings, the electric stapler according to the invention is not limited to the electric stapler according to the third exemplary embodiment. It is obvious to those skilled in the art that various changes and modifications are possible without departing from the scope of the appended patent claims. It goes without saying that such changes and modification fall within the technological scope of the invention.

For example, in the electric stapler 30 according to the third exemplary embodiment, as shown in FIGS. 9A to 11D, description has been given above of a case in which the pulse signals to be output to the light emitting portions 14*a* and 15*a* are completely reverse with each other in phase (see FIGS. 9A to 9D), a case in which the pulse signals are out of phase with each other by a half cycle (see FIGS. 10A to 10D), and a case in which the pulse signals are slightly out of phase with each other (see FIGS. 11A to 11D). The relationship between the pulse signals to be output to the light emitting portions 14*a* and 15*a* are not limited to the above-mentioned examples. That is, the pulse signals to be output to the light emitting portions 14*a* and 15*a* may have any relationship between them, unless such relationship shows that the two pulse signals are perfectly the same, and provided that the two pulse signals are capable of blinking the light emitting portions 14*a* and 15*a* respectively at different blinking timings.

In case that the pulse signals to be output to the light emitting portions 14*a* and 15*a* are different from each other, the output signal of the synthesized component of the light received by the light receiving portion 15*b* shows a state which is different from the state of the pulse signal of the light emitting portion 14*a* and also from the state of the pulse signal of the light emitting portion 15*a*. Therefore, in the case that the detected output state of the photo transistor 21 corresponds to the pulse signal of the light emitting portion 15*a*, it is possible to determine that the paper bundle exists. On the other hand, in the case that the detected output state of the photo transistor 21 does not correspond to the pulse signal of the light emitting portion 15*a*, it is possible to determine that the paper bundle does not exist. That is, the insertion (existence) of the paper bundle can be determined quickly and positively.

In a related-art ordinary electric stapler, since various drive mechanism portions are provided in the neighboring portions of the setting position of the clincher provided on the table means, there is a tendency to limit the freedom of the disposing of the photo sensor around the setting position of the clincher. In order to confirm that the paper bundle surely exists (is surely inserted) upwardly of the clincher, ideally, the photo sensor may be set at a position which exists on the deep side of the clincher. However, in fact, it is very hard to set the photo sensor at such deep side position. On the other hand, in the case that the photo sensor is disposed at other position than the deep side position of the clincher, there is a fear that the paper bundle can be detected by the photo sensor before the paper bundle is surely inserted to the deep side of the clincher. This can raise a fear that the staple can be struck idly.

On the other hand, in the electric stapler according to the exemplary embodiments, the photo sensor is disposed on the table means in such a manner that the optical axis direction of a radiation light to be emitted from the photo sensor is inclined in the clincher direction, and the detection point of the paper bundle in the photo sensor is set to exist upwardly of the setting position of the clincher. This makes it possible to detect positively and quickly that the paper bundle has been inserted to a position existing right above the clincher, and thus to prevent the staple from being struck idly. Also, since the binding operation can be started immediately after detection of the paper bundle, the stability of the binding position can be enhanced and also processings from the detection of the paper bundle to the end of the binding operation can be carried out more quickly.

Also, the above-mentioned electric stapler according to the exemplary embodiment may also have another structure. For example, the photo sensor may include two photo sensors respectively disposed at the right and left side positions of the clincher in such a manner that the clincher is put between the two photo sensors. Specifically, the optical axis of the photo sensor set on the right side position may be inclined such that the above-mentioned detection point exists upwardly of the right end portion of the clincher, and the optical axis of the photo sensor disposed on the left side position may be inclined such that the detection point exists upwardly of the left end portion of the clincher.

As described above, in this structure, the two photo sensors are respectively provided at the right and left positions of the clincher, and the existence of the paper bundle can be detected at the detection points which respectively exist upwardly of the right and left end portions of the clincher. Therefore, for example, in the case that the paper bundle is inserted from one of the right and left directions, the present structure can prevent the binding operation from being executed in such a situation that the paper bundle covers only one of the right and left portions of the clincher and thus the paper bundle does not exist in the other portion of the clincher.

Also, since the two photo sensors are provided respectively at the right and left positions of the clincher, in the case that the paper bundle is inserted from the upper-stream side of the clincher and also in the case that the paper bundle is inserted from the right and left sides of the clincher, the state of insertion of the paper bundle can be confirmed positively by the two photo sensors. Thanks to this, the binding processing can be carried out positively regardless of the insertion direction and insertion speed of the paper bundle, and also the occurrence of idle striking of a staple can be prevented positively.

In the electric stapler according to the exemplary embodiment, on the table means, the first light emitting means is disposed adjacent to the left side position of the clincher, the second light emitting means is disposed adjacent to the right side position of the clincher, and the light receiving means is disposed adjacent to the first or second light emitting means, while the light receiving means is structured such that it receives at least one of the reflected light of the first radiation light emitted from the first light emitting means and the reflected light of the second radiation light emitted from the second light emitting means to thereby detect the output state of the reflected light received. Owing to this, by comparing the output state of the light receiving means in a situation where the paper bundle is inserted (set) into the table means and the output state of the light receiving means in a situation where the paper bundle is not inserted, the presence or absence of the paper bundle can be detected.

Further, in the electric stapler according to the exemplary embodiment, the light receiving means is capable of receiving both of the reflected light of the first radiation light emitted from the first light emitting means and the reflected light of the second radiation light emitted from the second light emitting means. Therefore, in the case that the reflected light of the first radiation light and the reflected light of the second radiation light are both received by the light receiving means, the output state of the synthesized light of the reflected light of the first radiation light and the reflected light of the second radiation light is detected.

In the case that the output state of the synthesized light is detected in this manner, since the light receiving means of the electric stapler according to the invention detects the output state of the synthesized light at a blinking timing in which the blinking timing of the first radiation light and the blinking timing of the second radiation light are synthesized together, the light receiving means provides an output state which is different from one at the blinking timing of only the first radiation light and also from one at the blinking timing of only the second radiation light.

Also, in the case that only the reflected light of the first radiation light is received by the light receiving means, the output state of the light receiving means provides an output state which corresponds to one at the blinking timing of the first radiation light. And, in the case that only the reflected light of the second radiation light is received by the light receiving means, the output state of the light receiving means provides an output state which corresponds to one at the blinking timing of the second radiation light.

On the other hand, since the light receiving means is disposed adjacent to the first or second light emitting means, in the case that the paper bundle is inserted into the table means, the first radiation light emitted from the first light emitting means and the second radiation light emitted from the second light emitting means are both covered by the paper bundle, whereby the reflected light receivable by the light receiving means provides the reflected light that is obtained when the radiation light emitted from one of the first and second light emitting means respectively disposed adjacent to the light receiving means is reflected by the paper bundle.

Therefore, by comparing the output state detected by the light receiving means and the blinking timing of the radiation light emitted from the light emitting means disposed adjacent to the light receiving means, in the case that the output state is equal to the blinking timing of the radiation light, it is possible to determine that the paper bundle has been inserted; and, on the other hand, in the case that the output state is different from the blinking timing of the radiation light but is equal to the synthesized timing of the blinking timing of the first radiation light in the first light emitting means and the blinking timing of the second radiation light in the second light emitting means, it is possible to determine that the paper bundle has not been inserted.

Further, since the distance from the table means to the driver means is short, even in the case that the light receiving means detects the reflected light of the radiation light emitted from the light emitting means, it is often difficult to detect with high accuracy whether the reflected light detected is the reflected light reflected by the paper bundle or the reflected light reflected by the driver means. However, even in this case, in the electric stapler according to the invention, the output state to be detected by the light receiving means in a situation where the paper bundle is not inserted provides the output state that corresponds to the synthesized timing obtained when the blinking timing of the first radiation light is synthesized together with the blinking timing of the second radiation light which is different from the blinking timing of the first radiation light. And, the output state to be detected by the light receiving means in a situation where the paper bundle has been inserted provides the output state that corresponds to the blinking timing of the radiation light emitted from the light emitting means disposed adjacent to the light receiving means. This can facilitate the enhancement in the comparison accuracy (detection sensitivity (S/N ratio)) of the output state, and thus the existence of the paper bundle can be detected with high accuracy.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. An electric stapler comprising:

a driver for driving leg portions of a bent-formed staple having a U-shaped section to penetrate the leg portions through a paper bundle;

a table including a clincher for bending and forming the penetrated leg portions inwardly, the table having a surface for holding the paper bundle between the driver and the table having a surface for holding the paper bundle between the driver and the table;

a motor for moving the table and the driver relative to each other;

a photo sensor for detecting an existence of the paper bundle inserted into a gap between the table and the driver; and a control portion for driving the motor when the paper bundle is detected by the photo sensor, wherein the photo sensor is disposed on the table in such a manner that a detection point of the photo sensor for detecting the paper bundle exists upwardly of a disposing position of the clincher by inclining an optical axis direction of a radiation light to be emitted from the photo sensor in a direction of the clincher such that the optical axis direction of the radiation light is oblique to an axis perpendicular to the surface of the table that holds the paper bundle.

2. The electric stapler according to claim 1, wherein the photo sensor includes: a first photo sensor disposed at a left side position of the clincher; and a second photo sensor disposed at a right side position of the clincher in such a manner that the clincher is interposed between the first and second photo sensors, wherein the first photo sensor is set such that a first optical axis of the first photo sensor is inclined to allow a first detection point of the first photo sensor to exist upwardly of a left end portion of the clincher, and wherein the second photo sensor is set such that a second optical axis of the second photo sensor is inclined to allow a second detection point of the second photo sensor to exist upwardly of a right end portion of the clincher.

3. The electric stapler according to claim 1, wherein the photo sensor includes: a first photo sensor disposed at a left side position of the clincher; and a second photo sensor disposed at a right side position of the clincher in such a manner that the clincher is interposed between the first and second photo sensors, wherein the first photo sensor includes a first light emitting unit disposed adjacent to the left side position of the clincher in a state where a first optical axis of a first radiation light to be emitted from the first light emitting unit is inclined in a direction just above the clincher, wherein the second photo sensor includes a second light emitting unit disposed adjacent to the right side position of the clincher in a state where a second optical axis of a second radiation light to be emitted from the second light emitting unit is inclined in the direction just above the clincher, wherein one of the first photo sensor and the second photo sensor includes a light receiving unit disposed adjacent to one of the first light emitting unit and the second light emitting unit for receiving at least one of a first reflected light of the first radiation light and a second reflected light of the second radiation light to detect an output state of one of the first reflected light and the second reflected light, wherein the first radiation light is configured to blink at a given blinking timing, and wherein the second radiation light is configured to blink at a given blinking timing different from the blinking timing of the first radiation light.

4. The electric stapler according to claim 3, wherein the light receiving unit includes:

a first light receiving unit disposed adjacent to the first light emitting unit; and a second light receiving unit disposed adjacent to the second light emitting unit.

* * * * *